US005227629A

United States Patent [19]

Miseki

[11] Patent Number: 5,227,629

[45] Date of Patent: Jul. 13, 1993

[54] QUADRUPOLE MASS SPECTROMETER

[75] Inventor: Kozo Miseki, Kyoto, Japan

[73] Assignee: Shimadzu Corporation, Kyoto, Japan

[21] Appl. No.: 800,069

[22] Filed: Nov. 29, 1991

[30] Foreign Application Priority Data

Nov. 30, 1990 [JP] Japan ..... 2-338663
Mar. 30, 1991 [JP] Japan ..... 3-093175

[51] Int. Cl.[5] ..... H01J 49/42
[52] U.S. Cl. ..... 250/292; 250/290
[58] Field of Search ..... 250/292, 290, 293, 281, 250/282

[56] References Cited

U.S. PATENT DOCUMENTS 3,147,445 9/1964 Wuerker et al. ..... 250/292
3,784,814 1/1974 Sakai et al. ..... 250/292
4,214,160 7/1980 Fies et al. ..... 250/292
4,703,190 10/1987 Tamura et al. ..... 250/292
5,089,703 2/1992 Schoen et al. ..... 250/292

OTHER PUBLICATIONS

"Quadrupole Mass Spectrometer and its applications", Peter H. Dawson (Editor), Elsevier Scientific Publishing Company, 1976.

*Primary Examiner*—Paul M. Dzierzynski
*Assistant Examiner*—Kiet T. Nguyen
*Attorney, Agent, or Firm*—Oliff & Berridge

[57] ABSTRACT

A small AC voltage $V_a \cdot \cos\omega_a t$ (perturbation AC voltage) is applied to the electrodes of a quadrupole mass spectrometer besides the normal DC and AC voltages U and $V \cdot \cos\omega t$ (mass scanning voltages). The perturbation AC voltage generates unstable bands UB1, UB2 in a triangular stable region SR and cut off the skirts of the peak profile of every mass, which enhances the resolution of masses in the mass spectroscopy and improves the reliability of the measurement results.

8 Claims, 3 Drawing Sheets

QUADRUPOLE MASS SPECTROMETER

The present invention relates to a quadrupole mass spectrometer or a quadrupole mass filter.

BACKGROUND OF THE INVENTION

A quadrupole mass spectrometer uses four rod electrodes which are placed parallel to one another and symmetrically in a square array around a center axis (z axis). A DC (direct current) voltage U and a high frequency AC (alternating current) voltage $V \cdot \cos\omega t$ are applied between a pair of electrodes placed on the x axis and the other pair of electrodes placed on the y axis. When ions are injected at the center of and parallel to the four rod electrodes (that is, along the z axis), ions having a certain mass can go through the space surrounded by the electrodes but ions having other masses disperse from the space. Since the mass of the ions that can go through the space depends on the magnitudes U and V of the DC and AC voltages, mass spectroscopic scanning can be made by changing the values of U and V while maintaining a certain relationship between them. After a scanning is made through masses of a certain range, a mass spectrum curve is obtained having peaks of masses of ions included in the injected ions.

For the proper functioning of the quadrupole mass spectrometer, the dimensions of the four electrodes must be exactly the same and they must be aligned exactly symmetrical. If such conditions are not satisfied, the quadrupole electric field produced by the four electrodes loses symmetry. In this case, peak profiles of the mass spectrum curve would have a long skirt or an irrelevant peak would appear on the skirt, which deteriorates the resolution of mass in mass spectroscopy.

SUMMARY OF THE INVENTION

Conventional quadrupole mass spectrometers alleviate such problem by selecting most matching parts (electrode rods) among a lot of parts manufactured and assembling the rod electrodes very carefully with high accuracy. The present invention addresses the problem by electrical measures.

According to the present invention, a quadrupole mass spectrometer comprises:

(a) a first pair of rod electrodes both placed parallel to a center axis in a first plane;

(b) a second pair of rod electrodes both placed parallel to the center axis in a second plane perpendicularly intersecting the first plane at the center axis;

(c) a DC source for applying a DC voltage U between the first pair of electrodes and the second pair of electrodes;

(d) a first AC source for applying a first AC voltage having an amplitude V and a frequency $\omega$ between the first pair of electrodes and the second pair of electrodes; and (e) a second AC source for applying a second AC voltage between the first pair of electrodes and the second pair of electrodes, the amplitude $V_a$ of the second AC voltage being smaller than the amplitude V of the first AC voltage and the frequency $\omega_a$ of the second AC voltage being different from the frequency $\omega$ of the first AC voltage.

The function of the quadrupole mass spectrometer of the present invention is now briefly described. In the Cartesian graph of U (magnitude of the DC voltage) and V (amplitude of the AC voltage) shown in FIG. 2, ions having a certain mass are stable in the region below a triangular curve SR1, and ions having another mass are stable in another triangular region SR2. The triangular stable regions SR1, SR2, SR3, etc., each corresponding to a mass, stand on the x axis orderly according to the mass. When the magnitudes U and V of the DC and AC voltages applied between the electrodes are changed according to the line L (which is referred to as the scanning line), ions disperse while the line L is out of the triangular stable regions SR1, SR2, etc. but go through the space while the line L is in the triangular stable regions SR1, SR2, etc. Thus a peak profile is obtained, as shown below the graph of FIG. 2, for each mass of ions included in the ions injected in the quadrupole mass spectrometer.

If the scanning line L can be set just grazing the apexes P of the triangular stable regions SR1, SR2, etc., the peak profile of every mass would be very sharp and every peak profile is clearly separated from the neighboring peak profile: that is, the resolution of mass could be very high. But, in practice, unbalance or dissymmetry among the electrodes makes the array of triangular stable regions SR1, SR2, etc. imperfect, which does not allow such subtle setting of the scanning line L.

In the quadrupole mass spectrometer of the present invention, the scanning line L can be set at deeper position below the apexes P of the triangular stable regions SR1, SR2, etc. The resultant longer skirts of each peak profile are dexterously truncated by applying a small amplitude (the second) AC voltage $V_a \cdot \cos\omega_a t$, which introduces unstable regions in the triangular stable region, to the electrodes besides the normal DC and AC voltages U and $V \cdot \cos\omega t$ (hereinafter referred to as the mass scanning voltages). Thus the height of a peak profile is not affected by the skirt of the neighboring peak profile, and peak profiles of neighboring masses are clearly separated. This enhances the resolution of masses in the mass spectroscopy and improves the reliability of the measurement results.

Another important thing is that the effect is obtained through electrical measures in the present invention, and needs no laborious and time consuming operations (such as selecting most matching parts and assembling with very high accuracy) in manufacturing quadrupole mass spectrometers.

In the quadrupole mass spectrometer of the present invention, it is preferable that the second AC voltage $V_a \cdot \cos\omega_a t$ is applied when the quadrupole mass spectrometer is scanning through masses that are heavier than a predetermined threshold mass. It is further preferable that the amplitude $V_a$ of the second AC voltage $V_a \cdot \cos\omega_a t$ increases as the mass increases while the quadrupole mass spectrometer is scanning, because higher resolution is needed at heavier masses in normal mass spectroscopy of the quadrupole mass spectrometer.

BRIEF DESCRIPTION OF THE ATTACHED DRAWINGS

DETAILED DESCRIPTION OF A PREFERRED EMBODIMENT

Figure 1:
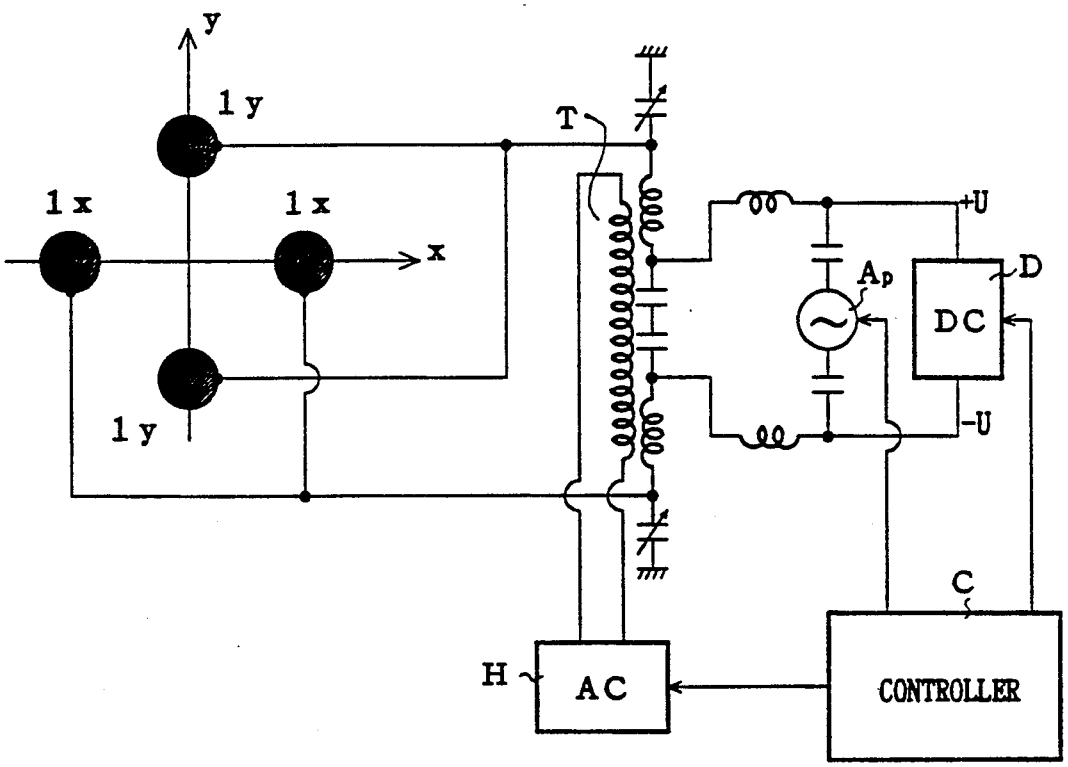
FIG. 1 is a schematic diagram of the construction of a quadrupole mass spectrometer as an embodiment of the present invention.

Schematic diagram of a quadrupole mass spectrometer embodying the present invention is shown in FIG. 1. In the mass spectrometer, DC voltage U and high frequency AC voltage $V \cdot \cos\omega t$ (mass scanning voltages) are simultaneously applied between a pair of electrodes 1x, 1x and the other pair of electrodes 1y, 1y. When ions of various masses are injected at the center of the space surrounded by the four electrodes 1x, 1x, 1y and 1y in the z direction (that is, perpendicular to the plane of the drawing), only such ions having a certain mass can go through the space, but ions having other masses oscillates strongly in the x-y plane and disperse from the space.

In the circuit diagram of the electrical system of the embodiment in FIG. 1, DC is the source of the DC component U of the mass scanning voltages, and AC is the source of the AC component $V \cdot \cos\omega t$ of the mass scanning voltages. The high frequency AC voltage $V \cdot \cos\omega t$ is applied to the electrodes via a transformer T. At the DC source D, the magnitude U of the DC voltage is variable, and at the AC source H the amplitude V of the AC voltage is variable. Both sources D and H are connected to a controller C, and the controller C changes the values of U and V according to the scanning line L of FIG. 2 in a mass spectroscopic measurement.

In the mass spectrometer of the present embodiment, another AC source Ap is provided parallel to the DC source D. The AC source Ap applies the second AC voltage $V_a \cdot \cos\omega_a t$ (hereinafter referred to as the perturbation AC voltage) to the electrodes under the control of the controller C.

Figure 2:
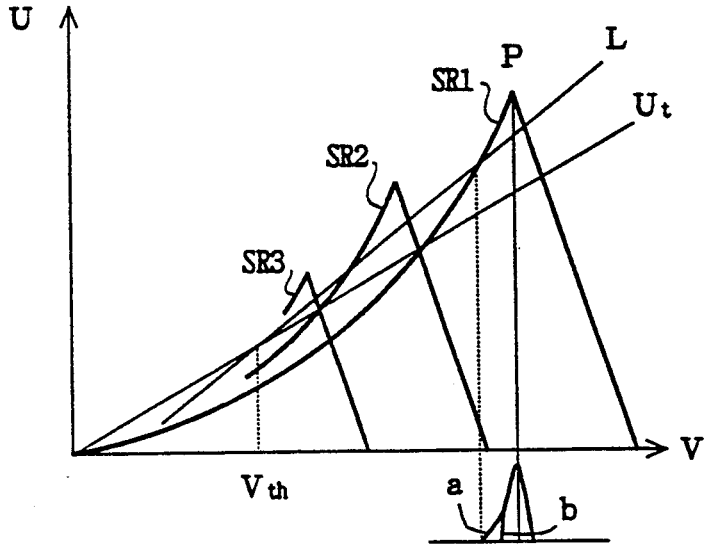
FIG. 2 is a graph showing triangular stable regions of various masses and a scanning line.

The function of the quadrupole mass spectrometer of the present embodiment is now described. The top part of a triangular stable region in FIG. 2 is enlarged in FIG. 3. The abscissa and ordinate are converted (normalized) appropriately from V and U in FIG. 2 to q and a in FIG. 3, so that the triangular stable regions SR1, SR2, etc. of various masses in the graph of FIG. 2 are represented by the sole triangular stable region SR in the graph of FIG. 3.

Figure 3:
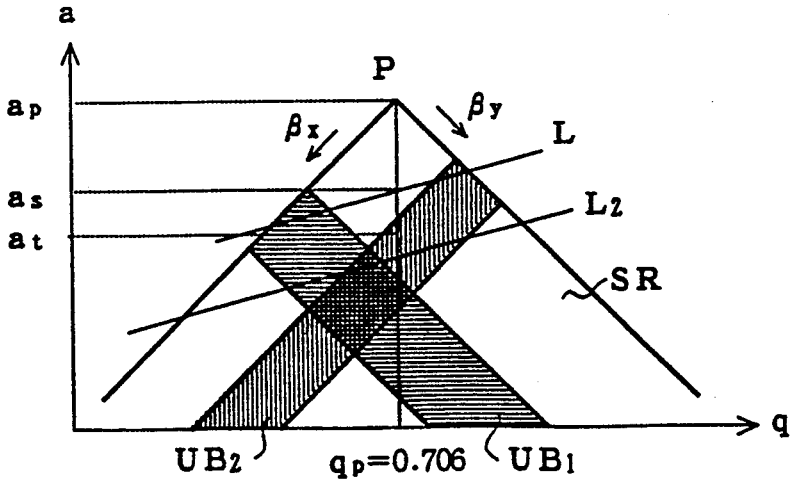
FIG. 3 is a graph of a normalized triangular stable region and unstable bands in it.

Since the position $q_p$ of the apex P is fixed ($q_p=0.706$) in the normalized graph of FIG. 3, the position of the peak of a peak profile does not move regardless of the position of the scanning line L. Therefore, the position $q_p$ of the peak of a peak profile represents a mass, and from $q_p=4 \cdot e \cdot V/(m \cdot r^2 \cdot \omega^2)$, the value of V at the peak determines the value of mass corresponding to the peak profile, as $$m=4 \cdot e \cdot V/(0.706 \cdot r^2 \cdot \omega^2)=b \cdot V,$$

$$b=4 \cdot e/(0.706 \cdot r^2 \cdot \omega^2)\ (constant).$$

When only the mass scanning voltages U and $V \cdot \cos\omega t$ are applied, ions having a mass M are stable in the triangular region SR in FIG. 3. But, it is found by the inventor, when another AC voltage $V_a \cdot \cos\omega_a t$ (perturbation AC voltage) having smaller amplitude and different frequency $\omega_a$ is further applied besides the AC voltage $V \cdot \cos\omega t$, the motion of the ions having mass M becomes unstable in the stratum-like regions (hatched in FIG. 3, and hereinafter referred to as the unstable bands) UB1 and UB2 emerging within the triangular stable region SR. When the magnitudes U and V of the mass scanning voltages (which are changed on the scanning line L) come in the unstable bands UB1 and UB2, the ions cannot go through the space surrounded by the electrodes in the z direction, but they disperse. Thus every peak profile becomes sharper as shown by the curve b in FIG. 2, where a skirt of the curve is cut off and no irrelevant peak appears on the skirt, compared to the curve a without the perturbation AC voltage $V_a \cdot \cos\omega_a t$. This enhances the resolution of mass in the mass spectroscopy.

The perturbation AC voltage $V_a \cdot \cos\omega_a t$ is quantitatively discussed. In order for the unstable bands UB1 and UB2 to be effective in cutting off the skirts of the peak profile and to enhance the resolution of mass, the width of the unstable bands UB1 and UB2 should become larger as the scanning line L comes higher (that is, as the mass increases). The abscissa q and ordinate a of the graph of FIG. 3 is converted from those V and U of FIG. 2 as:

$$q=(4 \cdot e/(m \cdot r^2 \cdot \omega_2)) \cdot V$$

$$a=*8 \cdot e/(m \cdot r^2 \cdot \omega^2)) \cdot U$$

where m: mass of an ion, and r: inscribed radius of the four rod electrodes.

Using parameters $\beta x$ and $\beta y$ representing apex P along the slopes of the triangular stable region SR (where $0 \leqq \beta x \leqq 1$, $0 \leqq \beta y \leqq 1$, and $\beta x$ decreases from 1, $\beta y$ increases from 0 as they move from the apex P towards the feet), the unstable bands UB1, UB2 are formulated as:

$$-\epsilon+(\omega_a/\omega)^2 < \beta y^2 < \epsilon+(\omega_a/\omega)^2$$

$$-\epsilon+(\omega_a/\omega)^2 < (1-\beta x)^2 < \epsilon+(\omega_a/\omega)^2$$

where $\epsilon=4 \cdot e \cdot V_a/(m \cdot r^2 \cdot \omega^2)$. Here $\epsilon$ is the half width of the unstable bands UB1, UB2, and $(\omega_a/\omega)^2$ is the center position of the unstable bands UB1, UB2. The two unstable bands UB1, UB2 move interlockingly as the value $\omega_a/\omega$ changes and neither can move independently.

Though both the frequency $\omega_a$ and amplitude $V_a$ of the perturbation AC voltage affect the shape of the peak profile, it is preferable to change the amplitude $V_a$ to control the relative position of the scanning line L and the unstable bands UB1, UB2 because, among the two parameters, the amplitude $V_a$ is easier to change.

Figure 5:
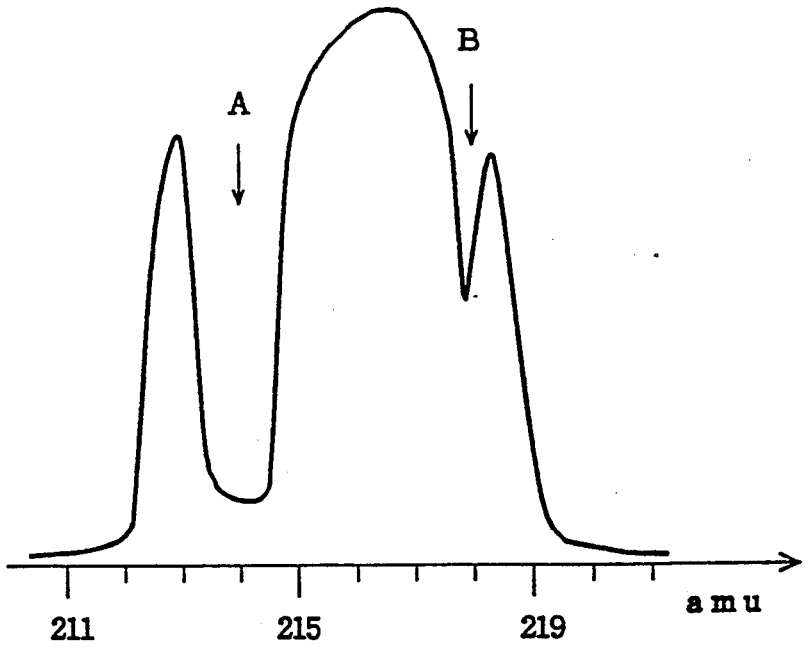
FIG. 5 shows a peak profile having dips caused by improper setting of unstable bands.

When the amplitude $V_a$ of the perturbation AC voltage is increased, the unstable bands UB1, UB2 widen and the stable region narrows, which enhances the resolution of the mass spectroscopy. But, if the position and width of the unstable bands UB1, UB2 are determined improperly in relation to the scanning line L, the unstable bands UB1, UB2 are included within the peak profile and dips A or B appear on the skirts of the peak profile as shown in FIG. 5, where a peak profile of a mass is hypothetically broadened to several atomic mass units (amu) by lowering the scanning line L to $L_2$ (FIG. 3).

In one example, the amplitude $V_a$ of the perturbation AC voltage $V_a \cdot \cos\omega_a t$ is of the order of several volts, while that of the mass scanning AC voltage V is of the order of kilovolts, and the frequency $\omega_a$ is about 1/20 times that of $\omega$.

As mentioned before, the magnitude U of the mass scanning DC voltage and the amplitude V of the mass scanning AC voltage are changed according to a scanning line L. In normal mass spectroscopy, the inclination and altitude of the scanning line L are normally decided so that the resolution of mass becomes proportional to the mass, in which case the scanning line L is formulated as $U=k\cdot V-h$ (FIG. 2). When the resolution of mass is proportional to the mass, the shape of the peak profile is insignificant at smaller masses with low resolution but significant at larger masses with high resolution. It is preferable, therefore, to apply the perturbation AC voltage $V_a\cdot\cos\omega_a t$ only at larger masses in the mass spectroscopic scanning, and it is further preferable to increase the amplitude $V_a$ of the perturbation AC voltage $V_a\cdot\cos\omega_a t$ as the mass increases.

In the present embodiment, a reference line $U_t$ is introduced in the graph of FIG. 2. The ordinate U is directly proportional to V on the reference line $U_t$, and the inclination of the reference line $U_t$ is set smaller than that of the scanning line L. In this case, the reference line $U_t$ crosses the scanning line L at $V=V_{th}$: that is, the scanning line L surpasses the reference line $U_t$ when mass is greater than a threshold mass corresponding to $V_{th}$. The perturbation AC voltage $V_a\cdot\cos\omega_a t$ is applied while the scanning line L surpasses the reference line $U_t$, and the amplitude $V_a$ of the perturbation AC voltage $V_a\cdot\cos\omega_a t$ is set proportional to the difference in the ordinates of the scanning line L and the reference line $U_t$: that is, $$V_a=c\cdot(U-U_t)=c\cdot(U-g\cdot V).$$

In the diagram of FIG. 3, the ordinate of the reference line $U_t$ at this mass is denoted as $a_t$, where $$a_t=8\cdot e\cdot U_t/(m\cdot r^2\cdot\omega^2),$$

the ordinate of the scanning line L is denoted as $a_s$ and that of the apex P is denoted as $a_p$. As the mass increases, the scanning line L comes relatively closer to the apex P (that is, $a_s$ approaches $a_p$), and escapes the unstable bands UB1, UB2 unless the width of the unstable bands UB1, UB2 is increased. Thus the amplitude $V_a$ of the perturbation AC voltage $V_a\cdot\cos\omega_a t$ is set proportional to the difference between $a_s$ and $a_t$ which increases as $a_s$ approaches $a_p$.

As described before, the width of the unstable bands UB1, UB2 is $$\epsilon=4\cdot e\cdot V_a/(m\cdot r^2\cdot\omega^2).$$

When the amplitude $V_a$ of the perturbation AC voltage $V_a\cdot\cos\omega_a t$ is changed as $V_a=c\cdot(U-g\cdot V)$, the width of the band changes as $$\epsilon=4\cdot e\cdot c\cdot(U-g\cdot V)/(m\cdot r^2\cdot\omega^2).$$

Since the values of U and V are changed as $U=k\cdot V-h$ on the scanning line L, $$\epsilon=c\cdot(k'\cdot V-h)\cdot 4\cdot e/(m\cdot r^2\cdot\omega^2),$$

($k'=k-g$) and since the amplitude V of the mass scanning AC voltage is proportional to the mass, as described above, $$V=m/b$$

(b is constant), the width of the band is expressed as $$\epsilon=4\cdot c\cdot(k-g)\cdot e/(b\cdot r^2\cdot\omega^2)-4\cdot c\cdot h\cdot e/(m\cdot r^2\cdot\omega^2),$$

The above formula shows that the width $\epsilon$ of the unstable bands UB1, UB2 increases as the value of mass m increases.

Figure 4:
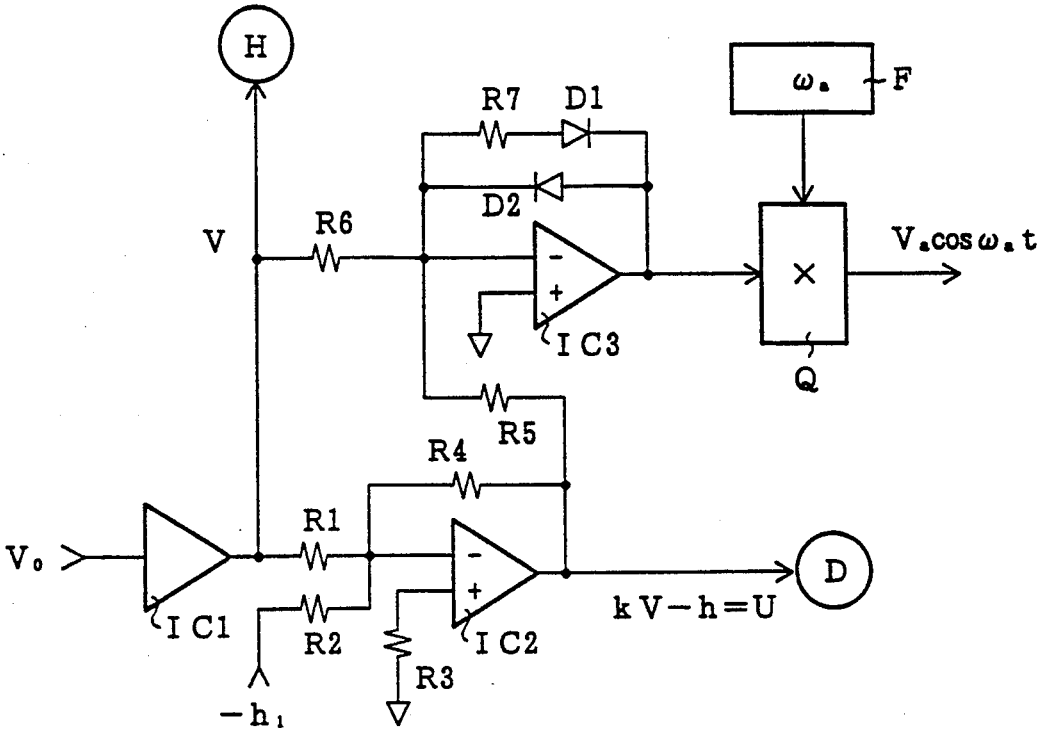
FIG. 4 is an example of a circuit for producing a perturbation AC voltage.

An example of the circuit is shown in FIG. 4 for producing the perturbation AC voltage $V_a$ holding the relation $$V_a=c\cdot(U-g\cdot V).$$

In the circuit of FIG. 4, a scanning signal $V_o$ is given to an amplifier IC1, and the output V of the amplifier IC1 is provided to the high frequency AC source H, where the mass scanning AC voltage $V\cdot\cos\omega t$ is produced. The output V of the amplifier IC1 is also provided to a first adder (operational amplifier) IC2 through a resistance R1, where a constant $-h_l$ is further provided through a resistance R2. By appropriately selecting the resistances R1, R2, R3 and R4 around the adder IC2, the output of the first adder IC2 can be made as $$-(k\cdot V-h)=-U.$$

The output $-U$ of the first adder IC2 is provided to the DC source D, where the mass scanning DC voltage U is produced. The output $-U$ of the first adder IC2 is also sent to a second adder (operational amplifier) IC3 through a resistance R5, where the output of the amplifier IC1 is also provided through a resistance R6. By appropriately selecting the resistances R5, R6 and R7 around the second adder IC3, the output of the second adder IC3 can be made as $$c\cdot(U-g\cdot V)=V_a.$$

Thus, in the circuit of FIG. 4, the amplitude $V_a$ of the perturbation AC voltage can be determined (or changed) by setting the values of the resistances. Diodes D1 and D2 are provided between the feedback path of the second adder IC3 in order to make the output zero when the output $c\cdot(U-g\cdot V)$ is negative (that is, when the scanning line L is below the reference line $U_t$ in FIG. 2). The output $V_a$ of the second adder IC3 is sent to a multiplier Q, where the perturbation AC voltage $V_a\cdot\cos\omega_a t$ is produced using an oscillating signal $V_x\cdot\cos\omega_a t$ ($V_x$ is a constant) from an oscillator F. The amplifier IC1 and the adders IC2 and IC3 with the surrounding resistances and diodes are included in the controller C of the circuit of FIG. 1, and the oscillator F and the multiplier Q constitutes the additional AC source Ap.

In the foregoing embodiment, the perturbation AC voltage $V_a\cdot\cos\omega_a t$ is applied between a pair of electrodes 1x, 1x and the other pair of electrodes 1y, 1y when the mass scanning voltages U and $V\cdot\cos\omega t$ are applied between the pairs. The above effect of the present invention is still obtained if the perturbation AC voltage is applied unilaterally to a pair of electrodes 1x, 1x (or, alternatively, unilaterally to the other pair of electrodes 1y, 1y) when the mass scanning DC voltages $+U$ and $-U$ of opposite polarities are respectively applied to the pairs and the mass scanning AC voltages $+V\cdot\cos\omega t$ and $-V\cdot\cos\omega t$ of opposite polarities are respectively applied to the pairs.

What is claimed is:

1. A quadrupole mass spectrometer comprising:

means for discriminating ions by mass;

said means for discriminating ions by mass comprising:

(a) a first pair of rod electrodes both placed parallel to a center axis in a first plane;

(b) a second pair of rod electrodes both placed parallel to the center axis in a second plane perpendicularly intersecting the first plane at the center axis;

(c) a DC source for applying a DC voltage U between the first pair of electrodes and the second pair of electrodes;

(d) a first AC source for applying a first AC voltage having an amplitude V and a frequency $\omega$ between the first pair of electrodes and the second pair of electrodes; and (e) a second AC source for applying a second AC voltage between the first pair of electrodes and the second pair of electrodes, the amplitude $V_a$ of the second AC voltage being smaller than the amplitude V of the first AC voltage and the frequency $\omega_a$ of the second AC voltage being different from the frequency $\omega$ of the first AC voltage.

2. A quadrupole mass spectrometer, as claimed in claim 1, where the second AC voltage is applied when the quadrupole mass spectrometer is scanning through masses that are heavier than a predetermined threshold mass.

3. A quadrupole mass spectrometer, as claimed in claim 2, where the amplitude $V_a$ of the second AC voltage increases as the mass increases while the quadrupole mass spectrometer is scanning.

4. A quadrupole mass spectrometer, as claimed in claim 3, where the amplitude $V_a$ of the second AC voltage is set proportional to the difference between the DC voltage U and a reference value $U_t$ which is changed directly proportional to the mass m, as $$V_a = c \cdot (U - U_t),$$

$$U_t = g \cdot V,$$

$$V = m/b,$$

where c, g and b are constants, while the DC voltage U and the amplitude V of the first AC voltage is changed as $$U = k \cdot V - h,$$

where k and h are constants.

5. A quadrupole mass spectrometer, as claimed in claim 4, where the second AC voltage is applied to either one of the first pair of electrodes or the second pair of electrodes.

6. A quadrupole mass spectrometer, as claimed in claim 2, where the second AC voltage is applied to either one of the first pair of electrodes or the second pair of electrodes.

7. A quadrupole mass spectrometer, as claimed in claim 3, where the second AC voltage is applied to either one of the first pair of electrodes or the second pair of electrodes.

8. A quadrupole mass spectrometer, as claimed in claim 1, where the second AC voltage is applied to either one of the first pair of electrodes or the second pair of electrodes.

* * * * *